US007812542B2

(12) United States Patent
Hergenhan et al.

(10) Patent No.: US 7,812,542 B2
(45) Date of Patent: Oct. 12, 2010

(54) ARRANGEMENT AND METHOD FOR THE GENERATION OF EXTREME ULTRAVIOLET RADIATION BY MEANS OF AN ELECTRICALLY OPERATED GAS DISCHARGE

(75) Inventors: Guido Hergenhan, Grossloeblchau (DE); Christian Ziener, Jena (DE); Mike Moeritz, Jena (DE)

(73) Assignee: XTREME technologies Gmbh, Goettingen (DE)

( * ) Notice: Subject to any disclaimer, the term of this patent is extended or adjusted under 35 U.S.C. 154(b) by 290 days.

(21) Appl. No.: 12/018,353

(22) Filed: Jan. 23, 2008

(65) Prior Publication Data

US 2008/0180029 A1 Jul. 31, 2008

(30) Foreign Application Priority Data

Jan. 25, 2007 (DE) ..... 10 2007 004 440

(51) Int. Cl.
*H05B 31/26* (2006.01)

(52) U.S. Cl. ..... 315/111.21; 315/111.31; 315/111.91; 250/504 R

(58) Field of Classification Search ..... 315/111.21, 315/111.31, 111.41, 111.71–111.91; 250/493.1, 250/504 R, 505.1
See application file for complete search history.

(56) References Cited

U.S. PATENT DOCUMENTS 6,414,438 B1 * 7/2002 Borisov et al. ..... 315/111.31
6,677,600 B2 * 1/2004 Ikeuchi ..... 250/504 R
6,972,421 B2 * 12/2005 Melnychuk et al. ..... 250/504 R
7,049,614 B2 * 5/2006 Rice ..... 250/504 R
2005/0031502 A1 * 2/2005 Bristol et al. ..... 422/186.3
2007/0158594 A1 * 7/2007 Shirai et al. ..... 250/504 R
2008/0258085 A1 * 10/2008 Bauer ..... 250/504 R

FOREIGN PATENT DOCUMENTS

WO 2005/025280 3/2005

* cited by examiner

*Primary Examiner*—Douglas W Owens
*Assistant Examiner*—Tung X Le
(74) *Attorney, Agent, or Firm*—Frommer Lawrence & Haug LLP

(57) ABSTRACT

The object of an arrangement and a method for generating extreme ultraviolet radiation by an electrically operated gas discharge is to improve the adjustment of the layer thickness and, in particular, to prevent an uncontrolled accumulation of the metal layer to be applied to the rotary electrodes during pauses in the pulse operation for generating radiation when, e.g., liquid flows through these rotary electrodes for efficient cooling. In this connection, the rotating speed of the rotary electrodes can be increased in particular until there is always a freshly coated surface region of the electrodes in the discharge area at repetition frequencies of several kilohertz. An edge area to be coated on at least one electrode has at least one receiving area which extends in a closed circumference along the electrode edge on the electrode surface and which is formed so as to be wetting for the molten metal. A coating nozzle for regenerative application of the molten metal is directed to this receiving area and has a shutoff valve connected to a valve regulating device.

27 Claims, 4 Drawing Sheets

ARRANGEMENT AND METHOD FOR THE GENERATION OF EXTREME ULTRAVIOLET RADIATION BY MEANS OF AN ELECTRICALLY OPERATED GAS DISCHARGE

CROSS-REFERENCE TO RELATED APPLICATION

This application claims priority of German Application No. 10 2007 004 440.4, filed Jan. 25, 2007, the complete disclosure of which is hereby incorporated by reference.

BACKGROUND OF THE INVENTION a) Field of the Invention

The invention is directed to an arrangement for generating extreme ultraviolet radiation by means of an electrically operated gas discharge, containing a discharge chamber which has a discharge area for a gas discharge for forming a radiation-emitting plasma, a first disk-shaped electrode and a second disk-shaped electrode, at least one of which electrodes is rotatably mounted and has an edge area to be coated by a molten metal, an energy beam source for supplying a pre-ionization beam, and a discharge circuit connected to the electrodes for generating high-voltage pulses.

The invention is further directed to a method for generating extreme ultraviolet radiation by means of an electrically operated gas discharge for forming a radiation-emitting plasma from pre-ionized emitter material in which at least one rotatably mounted, disk-shaped electrode of a pair of electrodes provided for the gas discharge is coated in the edge area by a molten metal.

b) Description of the Related Art

Studies of a large number of electrode shapes for gas discharge sources such as, e.g., Z-pinch electrodes, hollow-cathode electrodes or plasma focus electrodes have shown that the life of electrodes constructed in these ways is insufficient for EUV projection lithography.

In contrast, rotary electrodes, as they are called, have turned out to be a very promising solution for appreciably increasing the life of gas discharge sources. One advantage is that these electrodes, which are disk-shaped in particular, can be cooled better. Another advantage consists in that inevitable electrode erosion can be prevented from shortening life by a constant renewal of the electrode surface.

A device previously known from WO 2005/025280 A2 uses rotating electrodes which are immersed in a vessel containing molten metal, e.g., tin, for regenerative application of a molten metal. The metal applied to the electrode surface is evaporated by laser radiation at the location where the two electrodes are closest together, whereupon the vapor is ignited by a gas discharge to form a plasma. The cooling of the electrodes is carried out by the metal baths.

The solution proposed in WO 2005/025280 has the following disadvantages: Because of the immersion process, the rotating speed of the electrodes is limited and is not sufficient for the required output specification of an EUV source. Owing to insufficient rotating speed, subsequent arrival of unconsumed electrode portions in the discharge area is too slow, which causes instabilities in the plasma generation. The rotating speed should be designed in such a way that the electrodes continue to rotate between two successive discharge pulses by an amount that is greater than the radius of the region of influence of the preceding discharge pulse on the electrode surface.

Because of the short dwell period of the electrodes in the molten metal, cooling the electrodes by means of the melt is insufficient for the required high output specifications. However, an additional cooling of the electrodes, for example, by a throughflow of water, would allow the temperature of the electrode surface to fall below the melting temperature of the metal applied by means of the molten baths during the prolonged pauses in the pulse operation provided for radiation generation which are common in exposure processes in semiconductor fabrication. This would result in a heavy, uncontrolled accumulation of the metal layer on the electrodes. Rapidly switching the additional cooling off and on would lead to a temperature gradient between the electrode surface and the interior of the electrode. Since this temperature gradient balances out when the additional cooling is switched off, an impermissibly high heating of the coolant can occur so that any gas bubbles that might possibly occur form a thermally insulating layer which prevents efficient cooling. Further, it is difficult to adjust the layer thickness of the applied material.

OBJECT AND SUMMARY OF THE INVENTION

Therefore, it is the primary object of the invention to facilitate adjustment of the layer thickness and, in particular, to prevent an uncontrolled accumulation of the metal layer to be applied to the rotary electrodes during pauses in the pulse operation for generating radiation when, e.g., liquid flows through these rotary electrodes for efficient cooling. In this connection, the rotating speed of the rotary electrodes can be increased in particular until there is always a freshly coated surface region of the electrodes in the discharge area at repetition frequencies of several kilohertz.

This object is met in an arrangement for generating extreme ultraviolet radiation by means of an electrically operated gas discharge of the type mentioned above in that the edge area to be coated has at least one receiving area, which extends in a closed circumference along the electrode edge on the electrode surface and which is formed so as to be wetting for the molten metal, and a coating nozzle for regenerative application of the molten metal having a shutoff valve connected to a valve regulating device is directed to this receiving area.

Particularly advisable, advantageous constructions and further developments of the arrangement according to the invention are indicated in the dependent claims.

The valve regulating device is preferably connected to a temperature measuring device for measuring the surface temperature of the electrodes.

The disk-shaped electrodes are outfitted with a permanently operating cooling device. The coolant to be used can have an operating temperature below the melting temperature of a material provided for the molten metal. For example, cooling channels through which a liquid flows and which can also have temperature regulating means can be provided in the disk-shaped electrodes for cooling purposes.

The coating nozzle can be directed to the electrode surface in an area of the electrode which is located opposite the discharge area and which is provided for applying the molten metal.

In another advantageous further development of the invention, the electrodes are constructed as circular disks, are rigidly connected to one another at a mutual distance and are supported so as to be rotatable around a common axis of rotation which coincides with their center axes of symmetry. Each of the electrodes contains, on electrode surfaces facing one another, the at least one receiving area which is formed so as to be wetting for the molten metal and to which a coating nozzle is directed.

In order to prevent electrical short-circuiting, it is advantageous when a disk-shaped insulating body which penetrates into the intermediate space between the two electrodes is provided in the electrode area to which the molten metal is to be applied. In this construction, the coating nozzles which are directed to the electrode surfaces of the two electrodes can be guided through the disk-shaped insulating body from opposite sides.

The arrangement according to the invention can be further developed in a particularly advantageous manner in that the coating nozzle comprises two microstructured plates which lie one on top of the other, and a portion of a first plate is perforated by a hole structure, the second plate being outfitted with a membrane which lies opposite to the hole structure and which is flexible toward the hole structure. A closure element for the hole structure which can be pressed against the hole structure by actuating means acting at the flexible membrane is arranged on the flexible membrane so that the flow of molten metal can be interrupted. Accordingly, a movement away from the hole structure allows the molten metal to resume flowing. The two plates enclose a channel into which the hole structure opens and which is guided out of the first plate as a nozzle outlet.

The hole structure can also serve as a filter for larger particles in order to prevent clogging of the coating nozzle in that the hole structure has hole diameters that are smaller than the diameter of the nozzle outlet. Further, the coating nozzle can be constructed so as to be heatable by means of a current-carrying resistor which is arranged on the surface of at least one of the plates.

A pre-ionization of the emitter material is advantageous for igniting the plasma, particularly the evaporation of a droplet of advantageous emitter material that is injected between the electrodes. For this purpose, on the one hand, an injection device is directed to the discharge area and supplies a series of individual volumes of an emitter material, which is used to generate radiation, at a repetition frequency corresponding to the frequency of the gas discharge and by limiting the amount of the individual volumes so that the emitter material which is injected into the discharge area at a distance from the electrodes is entirely in the gaseous phase after the discharge. On the other hand, the pre-ionization beam supplied by the energy beam source is directed synchronous to the frequency of the gas discharge to a location for plasma generation in the discharge area at a distance from the electrodes at which the individual volumes arrive and are successively ionized by the pre-ionization beam.

Alternatively, the ignition of the plasma can also be initiated in that the regeneratively applied molten metal is emitter material serving for the generation of radiation and the pre-ionization beam supplied by the energy beam source is directed to the emitter material synchronous to the frequency of the gas discharge in the discharge area.

Because of the discharge process in which a plasma radiating in the EUV range is formed, a portion of the layer applied to the electrode surface in the region of influence of the plasma is evaporated or is expelled as molten material. This amounts to several $10^{-7}$ to several $10^{-6}$ grams per pulse. This loss of mass is compensated by the steady supply of molten metal so that a constant protective layer remains on the electrode surface even under discharge conditions with repetition frequencies of several kilohertz.

The inventive application of molten metal is also particularly advantageous because the contact between the rotary electrodes and the discharge circuit can have a particularly low inductance owing to a horizontal arrangement of the two rotary electrodes.

Therefore, in another construction of the invention, the electrodes are in electrical contact with contact elements which are oriented coaxial to the axis of rotation and which are immersed in ring-shaped, electrically separated molten metal baths which are electrically separated from one another and which communicate with a discharge circuit of the high-voltage supply.

In another construction, the electric contacting can also be carried out by means of the coating nozzle and the liquid jet.

The above-stated object is further met according to the invention by a method for generating extreme ultraviolet radiation of the type mentioned above in that the regenerative coating of the edge area is controlled during the rotation depending on the electrode surface temperature.

According to the method, the coating is interrupted when the temperature drops below a limit temperature lying above the melting temperature of a material provided for the molten metal and is continued when the temperature rises above the limit temperature.

In a particularly advantageous manner, the electrodes are cooled during coating by a coolant which has an operating temperature below the melting temperature of the material provided for the molten metal. Further, the cooling can be regulated.

The invention will be described more fully in the following with reference to the schematic drawings.

DESCRIPTION OF THE PREFERRED EMBODIMENTS

Figure 1:
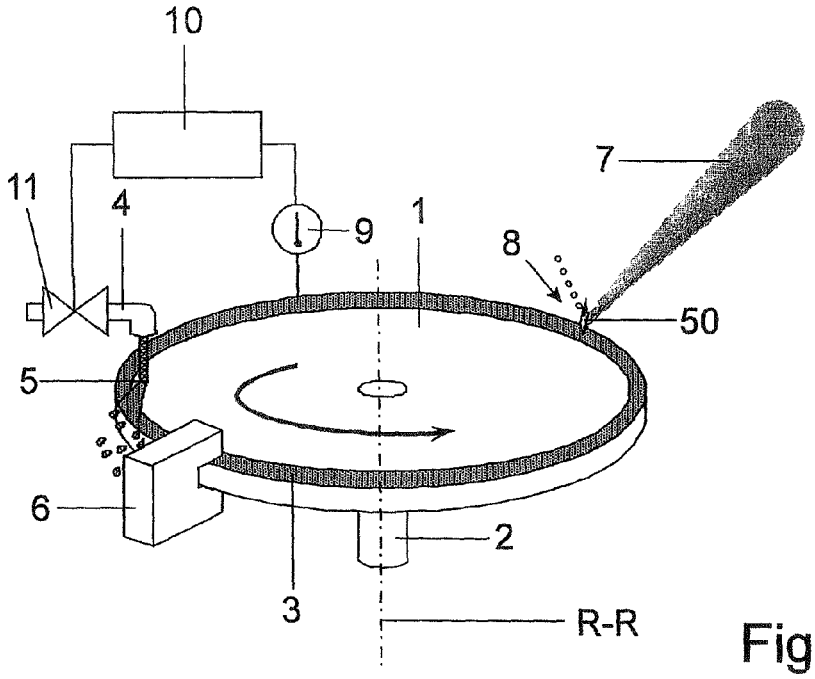
FIG. 1 shows the principle according to the invention for applying a defined thin layer of a molten metal along a track on a rotating electrode surface.

In FIG. 1, which serves to illustrate the principle of the invention, a disk-shaped electrode 1 is rigidly connected to a rotatable shaft 2 in such a way that the center axis of symmetry of the electrode coincides with the axis of rotation R-R. A circumferential edge track on the electrode surface serves as a receiving area 3 for a molten metal, e.g., tin or a tin alloy, and is formed so as to be wetting for this material. Surfaces for the edge track having a wetting action can be, e.g., copper, chromium, nickel or gold. However, a structural steel, heat-treated molybdenum or other electrically conductive materials are also suitable.

The rest of the electrode surface, or at least a portion of the electrode surface adjoining the receiving area, should not be wetting for the material to be applied because application of the molten metal to these areas is not wanted. Suitable non-wetting surfaces can comprise, e.g., PTFE, stainless steel, glass, or ceramic.

A coating nozzle 4 of a liquid generator, not shown, is directed to the receiving area 3 to apply the molten metal as a liquid jet 5 to the receiving area 3 in a regenerative manner during the rotation of the electrode 1. Due to the fact that the applied liquid metal is propelled to the edge of the electrode by the centrifugal force, it is necessary to provide a spray guard 6 to prevent detaching molten metal from spreading in an uncontrolled, unlimited manner.

An energy beam, e.g., a laser beam, which serves as a pre-ionization beam 7 is directed in a discharge area 8 to an injected droplet of advantageous emitter material in order to evaporate the latter.

The adjustment of a defined layer thickness for the metal to be applied within a range between 1 μm and 20 μm requires an electrode surface temperature above the melting temperature of the material to be applied. A temperature measuring device 9, for example, a pyrometer, carries out the measurement of the electrode surface temperature. A valve regulating device 10 connected to the temperature measuring device 9 ensures by means of a shutoff valve 11 that the supply of material and, therefore, the regenerative coating of the receiving area 3, is interrupted at a limit temperature that is still above the melting temperature of the material to be applied. However, when the electrode surface temperature increases again above the limit temperature, the shutoff valve 11 in the material feed is opened again proceeding from the valve regulating device 10 and the coating process is continued.

Figure 2:
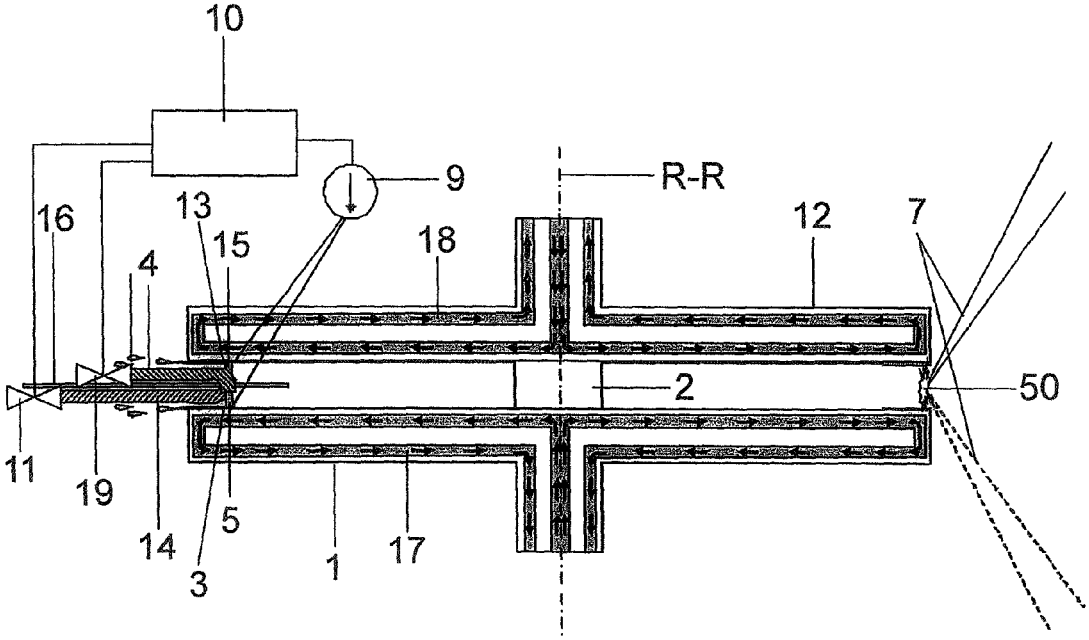
FIG. 2 shows an arrangement for applying a molten metal to oppositely located, liquid-cooled electrode surfaces of two electrodes that are rigidly connected to one another and mounted so as to be rotatable around a common axis.

In the construction shown in FIG. 2, a first and a second disk-shaped electrode 1, 12 are rigidly connected at a distance from one another to the rotatably mounted shaft 2 in such a way that the center axes of symmetry of the electrodes 1, 12 coincide with the axis of rotation (R-R) of the shaft 2. Each of the electrodes 1, 12 contains, on surfaces that face one another, a receiving area 3, 13 which is formed as an edge track and which has a wetting action for the molten metal, a coating nozzle 4, 14 being directed to these receiving areas 3, 13. The receiving areas 3, 13 are arranged on the electrode surfaces in such a way that they are located opposite one another.

A disk-shaped insulating body 16, particularly an electrically insulating ceramic plate which is immersed in the intermediate space between the two electrodes 1, 12 in an area of the electrode provided for applying the molten metal is provided for preventing electric short-circuiting between the electrodes 1, 12 due to the liquid jets 5, 15 of molten metal. As is shown in FIG. 2, the two coating nozzles 4, 14 are guided through the electrically insulating ceramic plate from opposite sides. One coating nozzle 4 acts in the direction of the force of gravity and the other coating nozzle 14 acts counter to the direction of the force of gravity.

The disk-shaped electrodes 1, 12 are penetrated by cooling channels 17, 18 through which a cooling liquid flows. Because cooling of this kind is relatively sluggish and therefore cannot be regulated quickly, it may happen during relatively short pauses in pulse operation that the temperature of the electrode surface drops below the melting temperature of the material to be applied. Therefore, as is described with reference to FIG. 1, the material feed is regulated depending on the electrode surface temperature and is interrupted by shutoff valves 11, 19 particularly when it falls below a limit temperature.

Figure 3:
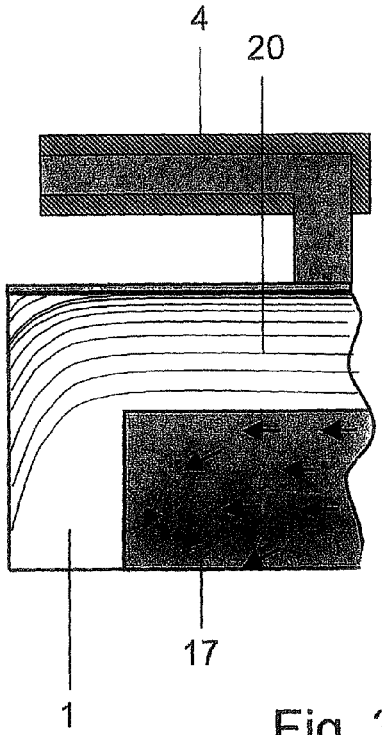
FIG. 3 shows the isothermal curve inside an electrode during pulse operation.

The curve of the isotherms 20 which is shown in FIG. 3 reflects a strong temperature gradient which results between electrode surfaces and the cooling channels during an ongoing pulse operation at maximum output. At a given temperature of the electrode surface of, e.g., around 500° C. at which the material applied to the edge area is liquid and at a cooling water temperature of, e.g., around 80° C., the regenerative rotational coating takes place.

Figure 4:
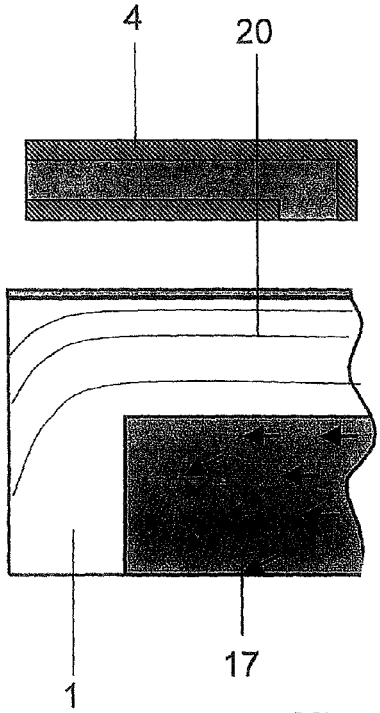
FIG. 4 shows the isothermal curve inside an electrode during a pause in the pulse operation.

On the other hand, if the temperature gradient flattens out during a pause in the pulse operation, the temperature of the electrode surface at about 120° C. lies below the melting temperature of the coating material. The temperature of the cooling water has fallen to approximately 40° C. The rotational coating is interrupted according to the invention (FIG. 4).

Figure 5:
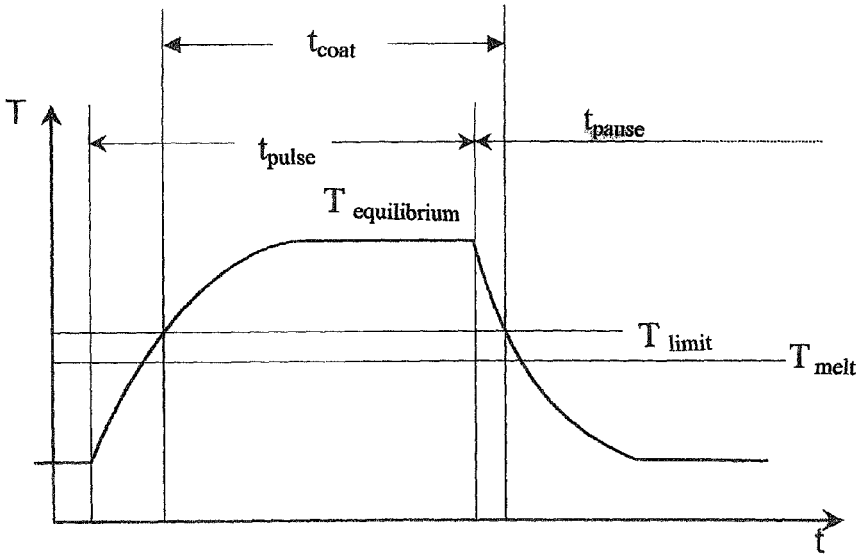
FIG. 5 shows the time temperature curve on the electrode surface depending on the operating state of the radiation source.

FIG. 5 shows the time-temperature curve on the electrode surface during period $t_{pulse}$ of the pulse operation for the pulsed generation of radiation and during a period $t_{pause}$ in which the pulse operation is adjusted and during which, accordingly, no radiation is generated. When after a sharp rise in temperature at the start of the pulse operation the temperature exceeds a limit temperature $T_{limit}$ above the melting temperature $T_{melt}$ of the material to be applied, the rotational coating is switched on for a period $T_{coat}$. Depending on the length of the pulse operation, an equilibrium temperature $T_{equilibrium}$ can occur until the temperature drops at the end of the pulse operation and, therefore, at the end of the pulsed generation of radiation. The rotational coating continues to be carried out until the temperature falls below the limit temperature $T_{limit}$. This results in the formation of a sacrificial layer which can be consumed at the start of the next pulse operation for as long as the electrode temperature remains below the limit temperature $T_{limit}$ for the rotational coating and the coating nozzles 4, 14 are switched off.

A coating nozzle carrying out the coating function according to FIG. 2 must have a flat structural shape in order to be able to penetrate into the gap between the disk-shaped electrodes. Further, a coating nozzle of this kind must be heatable to ensure that the molten metal remains liquid.

Figure 6:
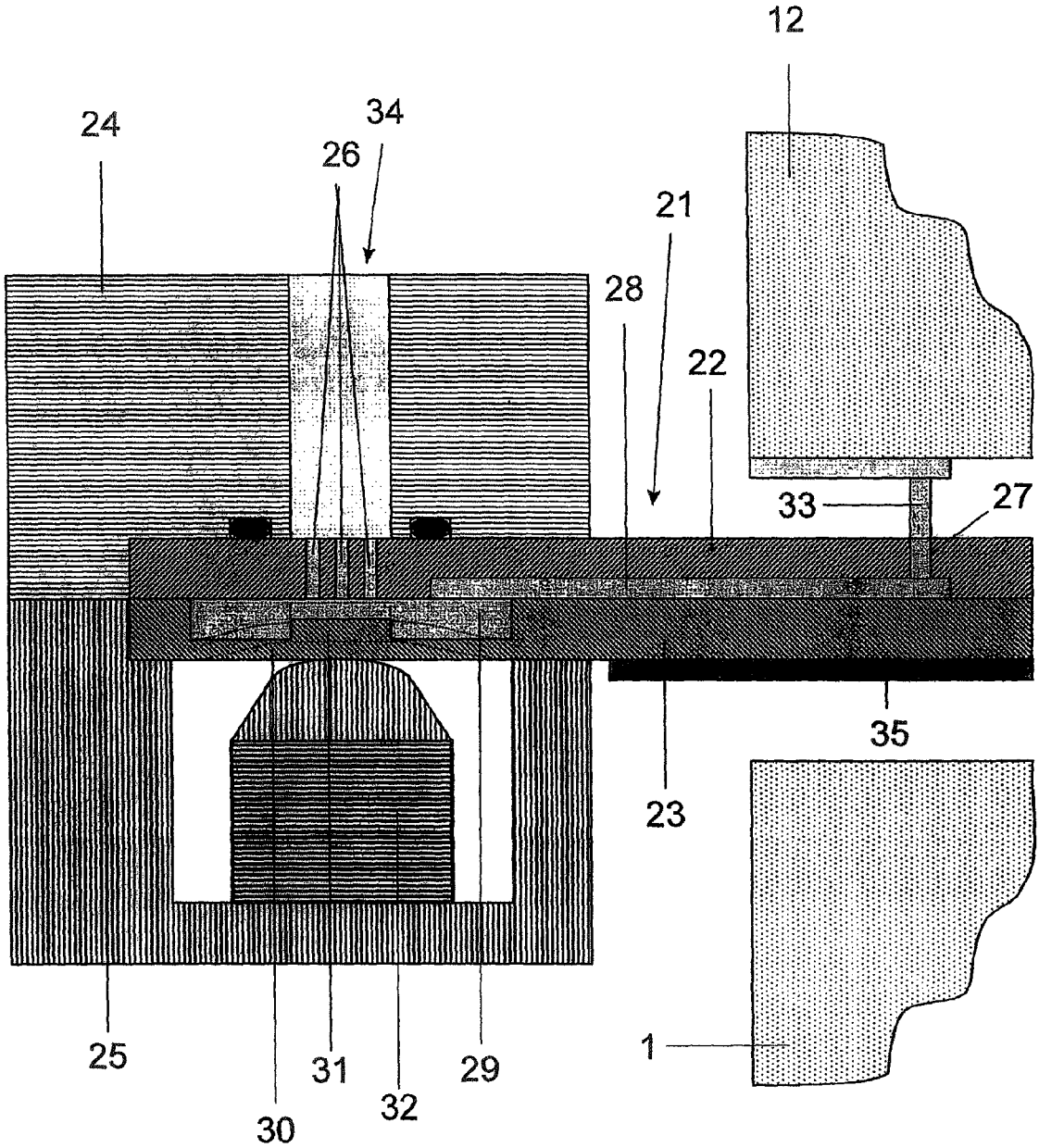
FIG. 6 is a sectional view showing an arrangement of a controllable coating nozzle between two electrodes.

A coating nozzle according to FIG. 6 which is manufactured using silicon layer technology and which contains an integrated shutoff valve comprises two silicon plates 22, 23, which are preferably anodically bonded, and is oriented with respect to its position to the edge area of an electrode, in this instance electrode 12, by holding elements 24, 25. The silicon plates 22, 23 are formed by established methods of silicon structuring, corresponding to the nozzle function to be carried out by them, as microstructured components. Openings in the form of a hole structure 26 with hole diameters which are preferably smaller than the diameter of a nozzle outlet 27 are incorporated in the silicon plate 22 which, in this instance, lies on top. A channel 28 that is fashioned in the silicon plate 22 leads to the nozzle outlet 27 and communicates with a recess 29 in the other silicon plate 23 into which the hole structure 26 opens. The hole structure 26 can advantageously form a filter for larger particles to prevent clogging of the nozzle structure.

A flexible membrane 30 which is arranged opposite the hole structure 26 and has a die-like closure element 31 that can be moved against the hole structure 26 by the bending of the membrane 30 is incorporated in the bottom silicon plate 23 referring to the drawing. Accordingly, by means of actuating means 32 accommodated in the holding element 25, the closure element 31 can be pressed against the hole structure 26 so that, if necessary, the supply of liquid coating material 33, a supply channel 34 being incorporated in the holding element 24 for this purpose, can be interrupted (shown in dashes). When the force of the actuating means 32 is withdrawn, the closure element 31 disengages from the hole structure 26 so that the flow of coating material 33 can resume.

By integrating the shutoff valve in the coating nozzle, the dead volume can be advantageously minimized in such a way that afterrunning of coating material or a delay in switching on can be prevented to a great extent, which is important particularly for fast switching cycles.

Figure 7:
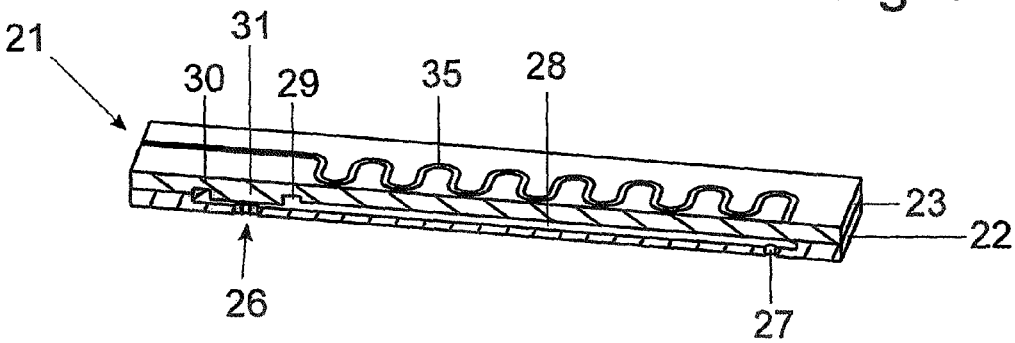
FIG. 7 shows a perspective view of a coating nozzle.

Finally, the coating nozzle 21 can be constructed so as to be heatable by a current-carrying resistor 35 (FIG. 7) arranged on the surface so that the molten metal does not solidify inside the coating nozzle 21. The current-voltage characteristic of the layer-type resistor 35 can be used simultaneously as a temperature measurement signal for regulating the temperature of the coating nozzle 21.

Figure 8:
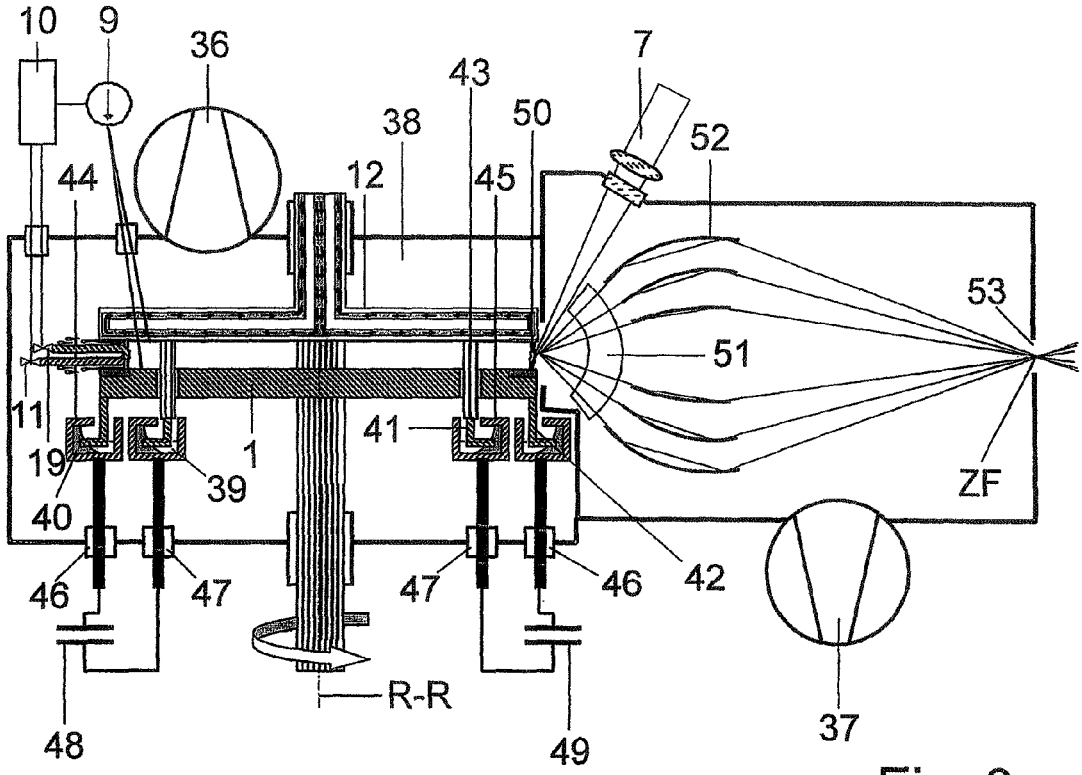
FIG. 8 shows a first construction of a radiation source with a rotary electrode arrangement according to the invention.

The radiation source shown in FIG. 8 comprises a rotary-electrode arrangement according to FIG. 2 in a discharge chamber 38 that can be evacuated by means of vacuum pumps 36, 37. Electric feeds to the electrodes 1, 12 are preferably formed by ring-shaped, electrically separated melt baths 39, 40 of molten metal, e.g., tin or other low-melting metal baths such as, e.g., gallium, in which the electrodes 1, 12 are immersed by contact elements 41, 42. The contact elements 41, 42 are either formed of a plurality of individual contacts (contact element 41) which are arranged along a circular ring on one electrode 12 and guided through openings 43 in the other electrode 1 so as to be electrically insulated, or they are formed as a closed cylindrical ring (contact element 42). Suitable partial covers of the metal baths 39, 40 in the form of inwardly turned-down outer walls 44, 45 prevent the pressed out molten metal from exiting from the vessels for the melt baths 39, 40.

Since an arrangement of the type mentioned above requires horizontally placed disk-shaped electrodes 1, 12 or a vertically directed axis of rotation R-R, a technique for applying a molten metal such as that provided by the invention is particularly advantageous because, contrary to what was previously known, the molten metal can be applied to the electrodes 1, 12 against the force of gravity.

By means of the rotary-electrode arrangement according to the invention, current pulses can be supplied to the electrodes 1, 12 without wear and, above all, with low inductance. Further, to this end, there is an electrical connection leading out of the discharge chamber 38 from the melt baths 39, 40 to capacitor elements 48, 49 via vacuum feedthroughs 46 to 47. The capacitor elements 48, 49 are part of a discharge circuit which, by generating high-voltage pulses at a repetition rate between 1 Hz and 20 kHz and with a sufficient pulse size, ensures that a discharge is ignited in the discharge area 8 which is filled with a discharge gas and that a high current density is generated which heats pre-ionized emitter material so that radiation of a desired wavelength (EUV radiation) is emitted by an occurring plasma 50.

After passing through a debris protection device 51, the emitted radiation arrives at collector optics 52 which direct the radiation to a beam outlet opening 53 in the discharge chamber 38. An intermediate focus ZF which is located in or in the vicinity of the beam outlet opening 53 is generated by the formation of the plasma 50 by means of the collector optics 52 and serves as an interface to exposure optics in a semiconductor exposure installation for which the radiation source, preferably formed for the EUV radiation range, can be provided.

Figure 9:
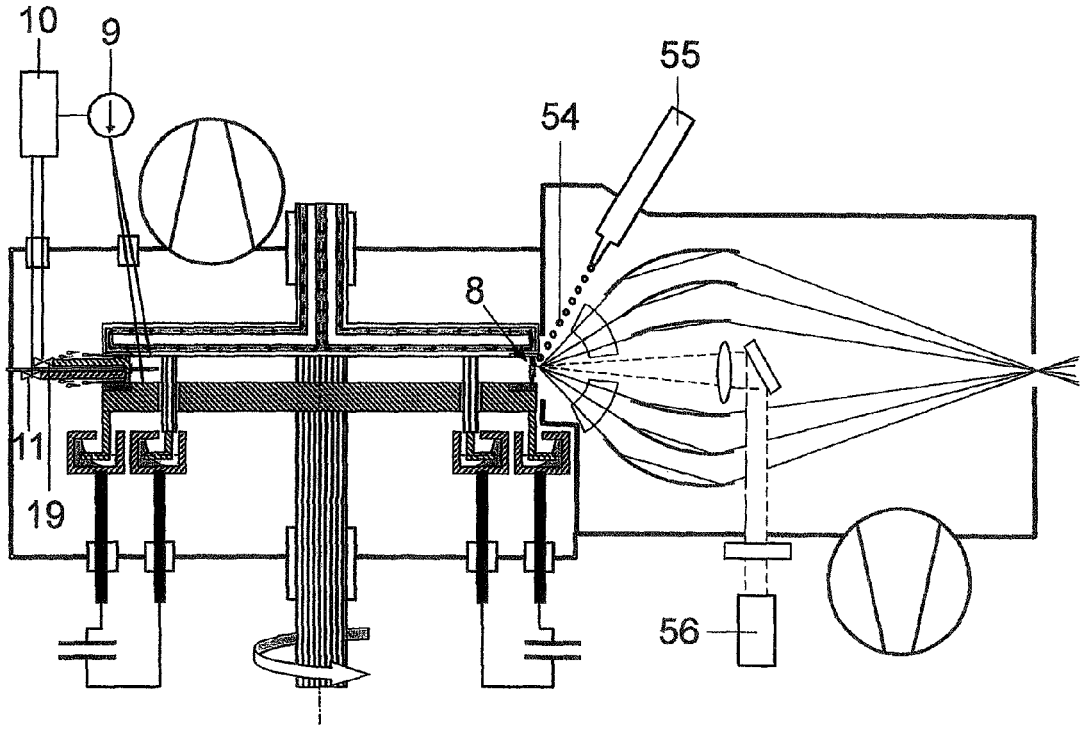
FIG. 9 shows a second construction of a radiation source with a rotary electrode arrangement according to the invention.

In a particularly advantageous manner, the ignition of the plasma 50 can be initiated by evaporation of a droplet of advantageous emitter material injected between the electrodes 1, 12. An advantageous emitter material of this kind can be xenon, tin, a tin alloy, a tin solution, or lithium. As was already shown in FIG. 1, the pre-ionization beam 7 which is directed to an injected droplet in the discharge area 8 synchronous to the frequency of the gas discharge serves to pre-ionize the emitter material. Therefore, in another construction according to FIG. 9, the emitter material is introduced into the discharge area 8 in the form of individual volumes 54, particularly at a location in the discharge area 8 provided at a distance from the electrodes 1, 12 at which the plasma generation is carried out. The individual volumes 54 are preferably supplied as a continuous stream of droplets in dense, i.e., solid or liquid, form through an injection device 55 directed to the discharge area 8 at a repetition frequency corresponding to the frequency of the gas discharge. The pulsed pre-ionization beam 7, preferably a laser beam of a laser radiation source, which is provided by an energy radiation source 56, is directed to the location of the plasma generation in the discharge area 8 synchronous to the frequency of the gas discharge in order to evaporate the droplet-shaped individual volumes 54.

When the molten metal applied to the electrodes 1, 12 for purposes of regeneration comprises emitter material, the energy beam 7 for the pre-ionization of the emitter material can also be directed thereto synchronous with the frequency of the gas discharge, specifically either to only one electrode 1 or 12 or to both electrodes 1, 12 simultaneously, or alternately to one and then the other electrode 1 or 12.

While the foregoing description and drawings represent the present invention, it will be obvious to those skilled in the art that various changes may be made therein without departing from the true spirit and scope of the present invention.

What is claimed is:

1. An arrangement for the generation of extreme ultraviolet radiation by means of an electrically operated gas discharge, comprising:

a discharge chamber which has a discharge area for a gas discharge for forming a radiation-emitting plasma;

a first disk-shaped electrode and a second disk-shaped electrode;

at least one of said electrodes being rotatably mounted and having an edge area to be coated by a molten metal;

an energy beam source for supplying a pre-ionization beam; and a discharge circuit connected to the electrodes for generating high-voltage pulses;

the edge area to be coated having at least one receiving area, which extends in a closed circumferential manner along the electrode edge on the electrode surface and which is formed so as to be wetting for the molten metal; and a coating nozzle for regenerative application of the molten metal having a shutoff valve connected to a valve regulating device being directed to said receiving area.

2. The arrangement according to claim 1, wherein the valve regulating device is connected to a temperature measuring device for measuring the surface temperature of the electrodes.

3. The arrangement according to claim 2, wherein the disk-shaped electrodes are outfitted with a permanently operating cooling device.

4. The arrangement according to claim 3, wherein a coolant to be used has an operating temperature below the melting temperature of a material provided for the molten metal.

5. The arrangement according to claim 4, wherein the cooling device is provided with means for regulating temperature.

6. The arrangement according to claim 5, wherein the disk-shaped electrodes are traversed by cooling channels through which a liquid flows.

7. The arrangement according to claim 1, wherein the coating nozzle is directed to the electrode surface in an electrode region which is located opposite the discharge area and which is provided for applying the molten metal.

8. The arrangement according to claim 7, wherein the electrodes are constructed as circular disks, are rigidly connected to one another at a mutual distance and are supported so as to be rotatable around a common axis of rotation which coincides with their center axes of symmetry, wherein each of the electrodes contains, on electrode surfaces facing one another, the at least one receiving area which is formed so as to be wetting for the molten metal and to which a coating nozzle is directed.

9. The arrangement according to claim 8, wherein a disk-shaped insulating body which penetrates into the intermediate space between the two electrodes to prevent electrical short-circuiting is provided in the electrode area to which the molten metal is to be applied.

10. The arrangement according to claim 9, wherein the coating nozzles which are directed to the electrode surfaces of the two electrodes are guided through the disk-shaped insulating body from opposite sides.

11. The arrangement according to claim 1, wherein the coating nozzle comprises two microstructured plates which lie one on top of the other, wherein a portion of a first plate is perforated by a hole structure, the second plate being outfitted with a membrane which lies opposite to the hole structure and which is flexible toward the hole structure, which membrane has a closure element for the hole structure which can be pressed against the hole structure by actuating means acting at the flexible membrane, and wherein the two plates enclose a channel into which the hole structure opens and which is guided out of the first plate as a nozzle outlet.

12. The arrangement according to claim 11, wherein the hole structure has hole diameters that are smaller than the diameter of the nozzle outlet.

13. The arrangement according to claim 12, wherein the coating nozzle is constructed so as to be heatable by a current-carrying resistor which is arranged on the surface of at least one of the plates.

14. The arrangement according to claim 1, wherein the electrodes are in electrical contact with contact elements which are oriented coaxial to the axis of rotation and which are immersed in ring-shaped, electrically separated molten metal baths which are electrically separated from one another and which communicate with a discharge circuit of the high-voltage supply.

15. The arrangement according to claim 1, wherein the electric contacting of the electrodes is carried out by means of the coating nozzle and a liquid jet dispensed by the coating nozzle.

16. The arrangement according to claim 1, wherein copper, chromium, nickel or gold are provided as wetting agent for the receiving area.

17. The arrangement according to claim 16, wherein at least a portion of the electrode surface adjoining the receiving area is constructed so as to be non-wetting for the molten metal.

18. The arrangement according to claim 17, wherein the portion of the electrode surface adjoining the receiving area comprises PTFE, stainless steel, glass, or ceramic.

19. The arrangement according to claim 1, wherein an injection device is directed to the discharge area and supplies a series of individual volumes of an emitter material, which is used to generate radiation, at a repetition frequency corresponding to the frequency of the gas discharge and by limiting the amount of the individual volumes so that the emitter material which is injected into the discharge area at a distance from the electrodes is entirely in the gaseous phase after the discharge.

20. The arrangement according to claim 19, wherein the pre-ionization beam supplied by the energy beam source is directed synchronous to the frequency of the gas discharge to a location for plasma generation in the discharge area at a distance from the electrodes at which the individual volumes arrive and are successively ionized by the pre-ionization beam.

21. The arrangement according to claim 1, wherein the regeneratively applied molten metal is emitter material serving for the generation of radiation and the pre-ionization beam supplied by the energy beam source is directed to the emitter material synchronous to the frequency of the gas discharge in the discharge area.

22. The arrangement according to claim 21, wherein the pre-ionization beam is simultaneously directed to the regeneratively applied emitter material of the first electrode (1) and second electrode.

23. The arrangement according to claim 1, wherein xenon, tin, tin alloys, tin solutions, or lithium are provided as emitter material.

24. A method for generating extreme ultraviolet radiation by an electrically operated gas discharge for forming a radiation-emitting plasma from pre-ionized emitter material comprising the steps of:

coating at least one rotatably mounted disk-shaped electrode of a pair of electrodes provided for the gas discharge in the edge area with a molten metal in a regenerating manner; and controlling the regenerative coating of the edge area during the rotation depending on the electrode surface temperature.

25. The method according to claim 24, wherein the coating is interrupted when the temperature drops below a limit temperature lying above the melting temperature of a material provided for the molten metal and is continued when the temperature rises above the limit temperature.

26. The method according to claim 25, wherein the electrodes are cooled during coating by a coolant which has an operating temperature below the melting temperature of the material provided for the molten metal.

27. The method according to claim 26, wherein the cooling is regulated.

* * * * *